US010227851B2

(12) United States Patent
Collins et al.

(10) Patent No.: US 10,227,851 B2
(45) Date of Patent: Mar. 12, 2019

(54) CONSISTENT ENTRY HOLE SHAPED CHARGE

(71) Applicant: Hunting Titan, Inc., Pampa, TX (US)

(72) Inventors: William Richard Collins, Burleson, TX (US); Mark Allan Pederson, Bynum, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 15/313,041

(22) PCT Filed: May 21, 2015

(86) PCT No.: PCT/US2015/032080

§ 371 (c)(1),
(2) Date: Nov. 21, 2016

(87) PCT Pub. No.: WO2015/179713

PCT Pub. Date: Nov. 26, 2015

(65) Prior Publication Data

US 2017/0199016 A1 Jul. 13, 2017

Related U.S. Application Data

(60) Provisional application No. 62/001,324, filed on May 21, 2014.

(51) Int. Cl.
*E21B 43/117* (2006.01)
*F42B 1/028* (2006.01)

(52) U.S. Cl.
CPC ..... *E21B 43/117* (2013.01); *F42B 1/028* (2013.01)

(58) Field of Classification Search
CPC ..... E21B 43/117; F42B 1/028
See application file for complete search history.

(56) References Cited

U.S. PATENT DOCUMENTS

| | | | | |
|---|---|---|---|---|
| 2,856,850 | A | 10/1958 | Church et al. | |
| 4,436,033 | A | 3/1984 | Preccul | |
| 4,672,896 | A | 6/1987 | Precoul | |
| 6,591,911 | B1 * | 7/2003 | Markel | E21B 43/117 102/312 |
| 6,840,178 | B2 | 1/2005 | Collins et al. | |

(Continued)

FOREIGN PATENT DOCUMENTS

FR 1022472 A 3/1953

OTHER PUBLICATIONS

Notification of Transmittal of the International Search Report and the Written Opinion of the International Searching Authority, PCT Application No. PCT/US2015/032080, dated Oct. 8, 2015, 11 pages.

(Continued)

*Primary Examiner* — Giovanna C. Wright
*Assistant Examiner* — Kristyn A Hall
(74) *Attorney, Agent, or Firm* — Jason Saunders; Christopher McKeon; Arnold & Saunders, LLP

(57) ABSTRACT

An apparatus and method for specialized shaped charges that perforate similar sized diameter holes regardless of the fluid gaps between the shaped charge and the casing wall. Shaped charges having three conical or frusto-conical liner sections are disclosed, where the apex liner section has a larger conical angle than the outer liner section are disclosed.

16 Claims, 2 Drawing Sheets

(56) References Cited

U.S. PATENT DOCUMENTS

| | | | | |
|---|---|---|---|---|
| 8,167,044 | B2 | 5/2012 | Huang et al. | |
| 2015/0323294 | A1* | 11/2015 | Scheid | F42B 1/02 102/307 |

OTHER PUBLICATIONS

Notification concerning transmittal of international preliminary report on patentability, PCT Application No. PCT/US2015/032080, dated Dec. 1, 2016, 7 pages.
Supplementary European Search Report, EP application No. 15796704.3 dated Oct. 18, 2017, 9 pages.
Office Action, Canadian application No. 2,933,225, dated Apr. 10, 2017, 4 pages.
Response to Office Action, Canadian application No. 2,933,225, dated Oct. 10, 2017, 6 pages.

* cited by examiner

CONSISTENT ENTRY HOLE SHAPED CHARGE

RELATED APPLICATIONS

This application claims priority to U.S. Provisional Application No. 62/001,324, filed May 21, 2014.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with a liner in the explosive material. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock.

A perforating gun has a gun body. The gun body typically is composed of metal and is cylindrical in shape. Within a typical gun tube is a charge holder, which is a tube that is designed to hold the actual shaped charges. The charge holder will contain cutouts called charge holes where the shaped charges will be placed.

A shaped charge is a term of art for a device that when detonated generates a focused explosive output. This is achieved in part by the geometry of the explosive in conjunction with a liner in the explosive material. Many materials are used for the liner; some of the more common metals include brass, copper, tungsten, and lead. When the explosive detonates the liner metal is compressed into a super-heated, super pressurized jet that can penetrate metal, concrete, and rock.

A typical shaped charge is carried in a cylindrical perforating gun. In any type of well, and especially in horizontal wells, the perforating gun will be decentralized. When lying on its side in a horizontal well, the shaped charges on one side of the gun may be further or closer to the casing than on the other side of the perforating gun. Further, it can be difficult to accurately control the direction a shaped charge may fire when located downhole. Most shaped charges create a decreasing hole diameter the further the shaped charge is from the casing. This distance is called the fluid gap in that it is the distance the explosion has to travel through fluid before reaching its intended target. Differently oriented shaped charges on a decentralized perforating gun will each have different fluid gaps with respect to each other.

In many applications it is desirable to have the perforated holes in the casing and formation to be as close as possible in diameter and penetration depth. Discrepancies between the different holes can cause issues later on. For instance, a subsequent fracking operation may not result in equal pressure going into each hole because of the different sizes. A need exists for a shaped charge that will consistently create holes in the formation of similar diameter and penetration depth irrespective of the orientation of the shaped charge.

SUMMARY OF EXAMPLES OF THE INVENTION

A need exists for a shaped charge that will consistently create holes in the formation of similar diameter and penetration depth irrespective of the orientation of the shaped charge. In the examples below several embodiments are shown for specialized shaped charges that can perforate similar sized holes regardless of the fluid gaps between the shaped charge and the casing wall. At least one embodiment of the invention includes a shaped charge comprising a case, an explosive material, a shaped charge liner further comprising an axis, a first section having a substantially conical shape, a first inner surface, a lowermost apex, a first conical angle respective to the first inner surface, a second section having a substantially frusto-conical shape, a second inner surface, a second conical angle respective to the second inner surface, a third section having a substantially frusto-conical shape, a third inner surface, a top surface perpendicular to the axis, a third conical angle respective to the third inner surface, wherein the first section, second section and third section are axially aligned about the axis, the second conical angle is larger than the first conical angle and the second conical angle is larger than the third conical angle, and a total height, wherein the total height is measured from the apex of the lowermost apex of the first section along the axis to a plane perpendicular to the top surface.

A variation of the embodiment may include the first conical angle being larger than or equal to the third conical angle. The embodiment may have a first conical angle between 44 and 52 degrees. The embodiment may have a second conical angle between 56 and 58 degrees. The embodiment may have a third conical angle between 44 and 54 degrees. The embodiment may have a first angle break where the first section and second section intersect. The embodiment may have a second angle break where the second section and the third section intersect. The embodiment may have a first height measured along the axis from the lowermost apex to a plane perpendicular to the first angle break. The embodiment may have a second height measured along the axis from the lowermost apex to a plane perpendicular to the second angle break. The embodiment may have the first height being between 26 and 34 percent of the total height. The embodiment may have the second height being between 70 and 73 percent of the total height.

At least one embodiment of the invention includes a method for perforating a formation comprising placing a perforating gun downhole at a predetermined location of a cased hole having an inner surface, placing a plurality of shaped charges in a plurality of orientations about the perforating gun, detonating a plurality of shaped charges in a plurality of directions, with a plurality of fluid gaps, and perforating consistent diameter holes in the case hole at a plurality of fluid gaps.

A variation of the embodiment may include the perforating gun being substantially cylindrical is located adjacent to the inner surface of the cased hole. It may also include the perforating gun being decentralized with respect to a center axis of the cased hole at the predetermined location. It may also comprise locating the plurality of shaped charges axially about the perforating gun at 60 degree angled intervals from each other. It may also further comprise penetrating formation between 29 and 44 inches. In the alternative it may also further comprise the plurality of shaped charges penetrating the formation between 35 and 38 inches. In the alternative it may further comprise the plurality of shaped charges penetrating the formation between 28 and 38 inches. In the alternative it may further comprise the plurality of shaped charges penetrating the formation between 30 and 36 inches. In the alternative it may further comprise the plurality of shaped charges penetrating the formation between 34 and 38 inches. In the alternative it may further comprise the plurality of shaped charges penetrating the formation between 17 and 34 inches. The invention may include the consistent diameter holes being defined as each hole diameter is less than a 10 percent deviation from the average hole size of the plurality of the holes.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
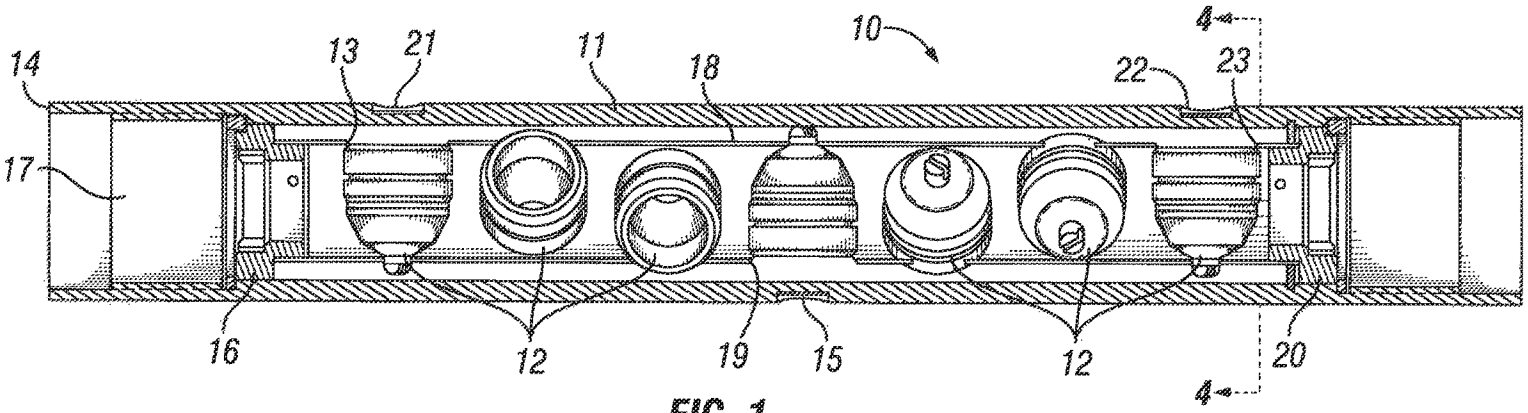
FIG. 1 is a side cross sectioned view of a perforating gun.

Referring to FIG. 1, a typical perforating gun 10 comprises a gun body 11 that houses the shaped charges 12. The gun body 11 contains end fittings 16 and 20 which secure the charge tube 18 into place. The charge tube 18 has charge holes 23 that are openings where shaped charges 12 may be placed. The gun body 11 has threaded ends 14 that allow it to be connected to a series of perforating guns 10 or to other downhole equipment depending on the job requirement. Other design variations may use ends that are bolted together. In FIG. 1, a 60 degree phase gun is shown where each shaped charge 12 is rotate about the center axis by 60 degrees from one shaped charge to the next. Other embodiments of this design are possible including zero degree phase guns, where all the shaped charges are aligned. Other end fittings or connections could be used in lieu of threaded fittings, such as bolted fittings.

Figure 2:
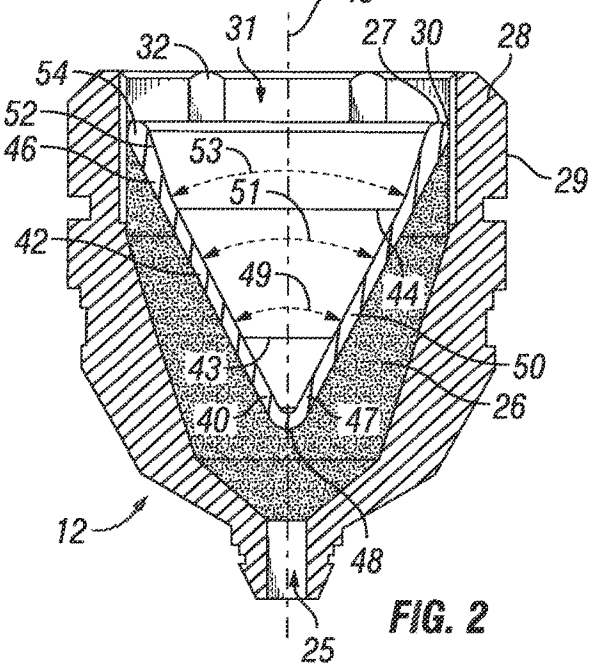
FIG. 2 is a side cross sectioned view of a shaped charge that may be used in a perforating gun.
Figure 3:
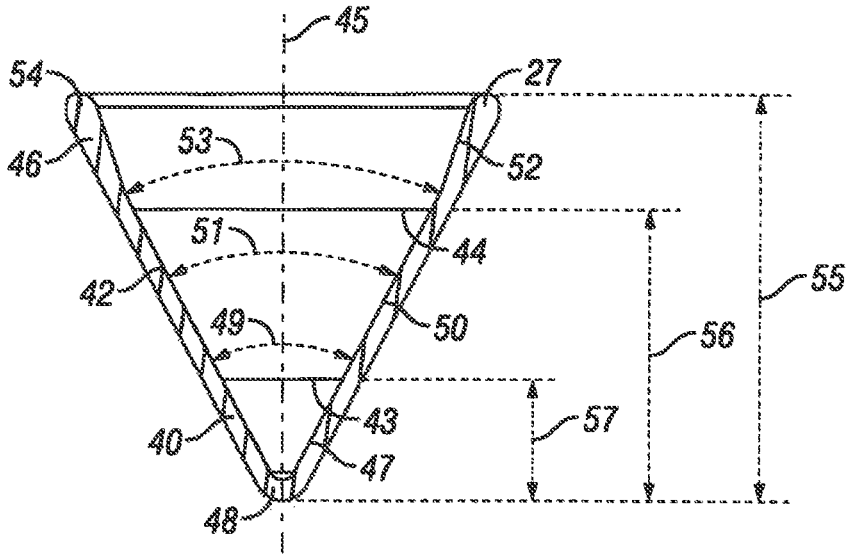
FIG. 3 is a side cross sectioned view of a liner that may be part of a shaped charge.

Referring to FIG. 2, the shaped charges 12 includes a shaped charge case 28 that holds the explosive material 26 and the liner 27. The shaped charge case 12 typically is composed of alloy steel. The liner 27 is usually composed of a powdered metal that is either pressed or stamped into place. The metals used in liner 27 include brass, copper, tungsten, and lead.

In this embodiment the liner 27 and energetic material 26 may be held in place by an adhesive, a snap ring, or some other retaining device. The shaped charge 12 may also include vent holes 32 in order to assist in allowing gases to vent out of the shaped charge 12 if an unplanned deflagration of the energetic material 26 occurs. The detonating cord that initiates the shaped charge 12 is placed adjacent to opening 25.

At least one embodiment of the invention includes a shaped charge comprising of a case 12, an explosive material 26, a shaped charge liner 27 further comprising an axis 45, a first section 40 having a substantially conical shape, a first inner surface 47, a lowermost apex 48, a first conical angle 49 respective to the first inner surface 47, a second section 42 having a substantially frusto-conical shape, a second inner surface 50, a second conical angle 51 respective to the second inner surface 50, a third section 46 having a substantially frusto-conical shape, a third inner surface 52, a top surface 54 perpendicular to the axis, a third conical angle 53 respective to the third inner surface 52, wherein the first section 40, second section 42 and third section 46 are axially aligned about the axis 45. The second conical angle 51 is larger than the first conical angle 49 and the second conical angle 49 is larger than the third conical angle 53. The liner 27 has a total height 55, wherein the total height 55 is measured from the lowermost apex 46 of the first section 40 along the axis 45 to a plane perpendicular to the top surface.

A variation of the embodiment may include the first conical angle 49 being larger than or equal to the third conical angle 53. The embodiment may have a first conical angle 49 between 44 and 52 degrees. The embodiment may have a second conical angle 51 between 56 and 58 degrees. The embodiment may have a third conical angle 53 between 44 and 54 degrees. The embodiment may have a first angle break. 43 where the first section 40 and second section 42 intersect. The embodiment may have a second angle break 44 where the second section 42 and the third section 46 intersect. The embodiment may have a first height 57 measured along the axis 45 from the lowermost apex 48 to a plane perpendicular to the first angle break 43. The embodiment may have a second height 56 measured along the axis 45 from the lowermost apex 48 to a plane perpendicular to the second angle break 44. The embody went may have the first height 57 being between 26 and 34 percent of the total height 55. The embodiment may have the second height 56 being between 70 and 73 percent of the total height 55.

Figure 4:
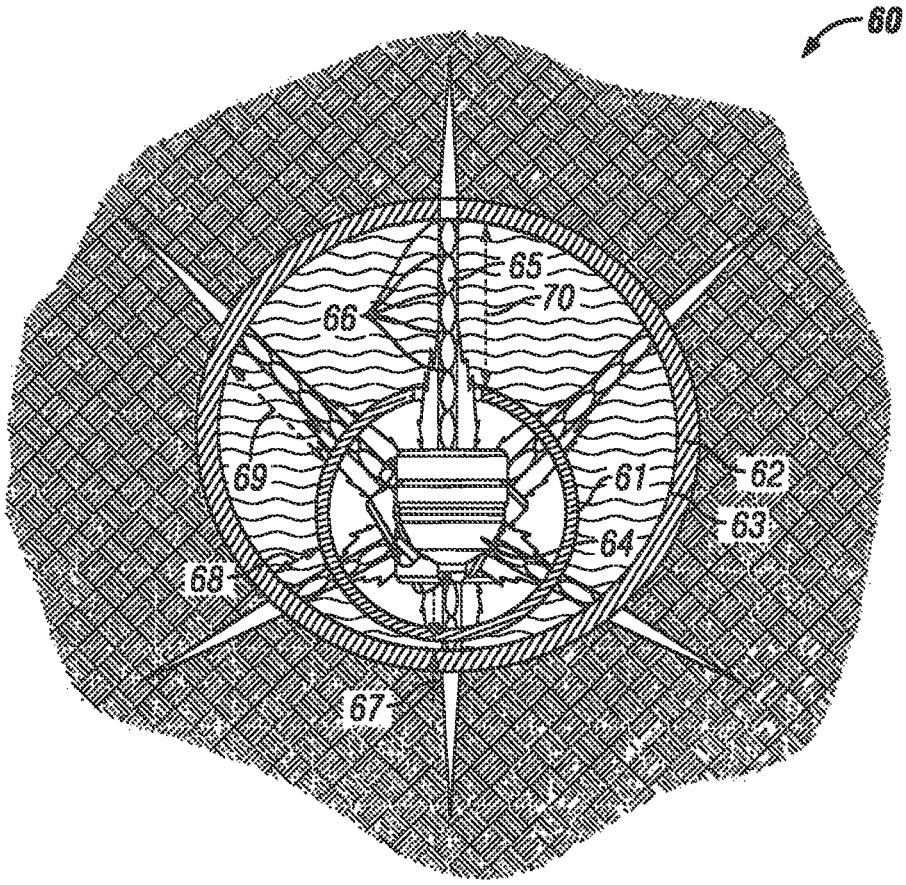
FIG. 4 is a view of the different shaped charges firing in different directions with multiple focal points.

Referring to FIG. 4, at least one embodiment of the invention includes a method for perforating a formation 60 comprising placing a perforating gun 61 downhole at a predetermined location of a cased hole 62 having an inner surface 63. Place a plurality of shaped charges 64, in this example there six shown, in a plurality of orientations about the perforating gun 61 using the liner configuration described herein. The embodiment includes detonating the plurality of shaped charges 64 in a plurality of directions, with a plurality of fluid gaps. This embodiment, using the liner described herein, can perforate consistent diameter holes in the case hole 63 at a plurality of fluid gaps.

The invention relies on the multiple focal points 66 of the explosive jets 65 that results from the liner configurations disclosed herein. In FIG. 4, there are six shaped charges 64 shown at 60 degrees of phase with respect to each other. There are four fluid gaps 67, 68, 69, 70. For example, placing a perforating gun 61 of a 3/18" size, decentralized in a 5.5 inch casing for a horizontal well results in a fluid gap 67 of 0.2", a fluid gap 68 of 0.5", a fluid gap 69 of 1.2", and a fluid gap 70 of 1.7". Therefore, each shaped charge 64 must have at least four focal points 66, that converge at approximately the same distances as the fluid gaps 67, 68, 69, and 70. This allows for the holes punctured at each focal point 66 to be roughly similar in diameter.

A variation of the embodiment may include the perforating gun 61 being substantially cylindrical and located adjacent to the inner surface 63 of the cased hole 62. It may also include the perforating gun 61 being decentralized with respect to a center axis of the cased hole 62 at the predetermined location. It may also comprise locating the plurality of shaped charges 64 axially about the perforating gun at 60 degree angled intervals from each other. It may also further comprise penetrating the formation 60 between 29 and 44 inches. In the alternative it may also further comprise the plurality of shaped charges 64 penetrating the formation 60 between 35 and 38 inches. In the alternative it may further comprise the plurality of shaped charges 64 penetrating the formation 60 between 28 and 38 inches. In the alternative it may further comprise the plurality of shaped charges 64 penetrating the formation 60 between 30 and 36 inches. In the alternative it may further comprise the plurality of shaped charges 64 penetrating the formation 60 between 34 and 38 inches. In the alternative it may further comprise the plurality of shaped charges 64 penetrating the formation 60 between 17 and 34 inches. The invention may include the consistent diameter holes being defined as each hole diameter having less than a 10 percent deviation from the average hole size of the plurality of the holes.

What is claimed is:

1. A shaped charge liner comprising:

an axis;

a first section having a substantially conical shape, a first inner surface, a lowermost apex, and a first cortical angle respective to the first inner surface;

a second section having a substantially frusto-conical shape, a second inner surface, and a second conical angle respective to the second inner surface;

a third section having a substantially frusto-conical shape, a third inner surface, a top surface perpendicular to the axis, and a third conical angle respective to the third inner surface;

wherein the first section, second section and third section are axially aligned about the axis, the second conical angle is larger than the first conical angle, the second conical angle is larger than the third conical angle, and the first conical angle is larger than or equal to the third conical angle;

a total height, wherein the total height is measured from the apex of the first section along the axis to a plane perpendicular to the top surface.

2. The apparatus of claim 1, wherein the first conical angle is between 44 and 52 degrees.

3. The apparatus of claim 1, wherein the second conical angle is between 56 and 58 degrees.

4. The apparatus of claim 1, wherein the third conical angle is between 44 and 54 degrees.

5. The apparatus of claim 1, having a first angle break where the first section and second section intersect and having a second angle break where the second section and the third section intersect.

6. The apparatus of claim 5, having a first height measured along the axis from the lowermost apex to a plane perpendicular to the first angle break and having a second height measured along the axis from the lowermost apex to a plane perpendicular to the second angle break.

7. The apparatus of claim 6, wherein the first height is between 26 and 34 percent of the total height.

8. The apparatus of claim 6, wherein the second height is between 70 and 73 percent of the total height.

9. A shaped charge comprising:

a case;

explosive material;

a liner further comprising:

an axis;

a first section having a substantially conical shape, a first inner surface, a lowermost apex, and a first conical angle respective to the first inner surface;

a second section having a substantially frusto-conical shape, a second inner surface, and a second conical angle respective to the second inner surface;

a third section having a substantially frusto-conical shape, a third inner surface, a top surface perpendicular to the axis, and a third conical angle respective to the third inner surface;

wherein the first section, second section and third section are axially aligned about the axis, the second conical angle is larger than the first conical angle, the second conical angle is larger than the third conical angle, and the first conical angle is larger than or equal to the third conical angle;

a total height, wherein the total height is measured from the lowermost apex of the first section along the axis to a plane perpendicular to the top surface.

10. The apparatus of claim 9, wherein the first conical angle is between 44 and 52 degrees.

11. The apparatus of claim 9, wherein the second conical angle is between 56 and 58 degrees.

12. The apparatus of claim 9, wherein the third conical angle is between 44 and 54 degrees.

13. The apparatus of claim 9, having a first angle break where the first section and second section intersect, and having a second angle break where the second section and the third section intersect.

14. The apparatus of claim 13, having a first height measured along the axis from the lowermost apex to a plane perpendicular to the first angle break, and having a second height measured along the axis from the lowermost apex to a plane perpendicular to the second angle break.

15. The apparatus of claim 14, wherein the first height is between 26 and 34 percent of the total height.

16. The apparatus of claim 15, wherein the second height is between 70 and 73 percent of the total height.

* * * * *